United States Patent [19]

Bier et al.

[11] 3,937,768

[45] Feb. 10, 1976

[54] VARIABLE VENTURI CARBURETOR

[75] Inventors: Kenneth C. Bier, Bloomfield Hills; Kalin S. Johnson, Northville; Ronald E. Herman, Romeo, all of Mich.

[73] Assignee: Colt Industries Operating Corporation, New York, N.Y.

[22] Filed: Feb. 27, 1975

[21] Appl. No.: 553,457

Related U.S. Application Data

[63] Continuation of Ser. No. 347,187, April 2, 1973, abandoned.

[52] U.S. Cl. ..... 261/44 R; 261/52; 261/DIG. 56

[51] Int. Cl.[2] ..... F02M 9/14

[58] Field of Search ..... 261/44 R, 52, 62, DIG. 56–DIG. 64

[56] References Cited

UNITED STATES PATENTS

| | | | |
|---|---|---|---|
| 2,084,489 | 6/1937 | Hess | 261/50 A |
| 2,118,220 | 5/1938 | Mock | 261/44 R |
| 2,195,867 | 4/1940 | Mallory | 261/52 |
| 2,215,682 | 9/1940 | Winkler | 261/39 C |
| 2,732,193 | 1/1956 | Wentz, Jr. | 261/44 R |
| 3,107,266 | 10/1963 | Wilson | 261/39 A |
| 3,284,061 | 11/1966 | Gordon | 261/39 C |
| 3,322,408 | 5/1967 | Stoltman | 261/52 |
| 3,334,876 | 8/1967 | Shorrock | 261/41 R |
| 3,680,846 | 8/1972 | Bickhaus et al. | 261/DIG. 56 |
| 3,746,321 | 7/1973 | De Pontac | 261/121 B |

FOREIGN PATENTS OR APPLICATIONS

| | | | |
|---|---|---|---|
| 128,710 | 11/1948 | U.S.S.R. | 261/DIG. 58 |

*Primary Examiner*—Tim R. Miles

[57] ABSTRACT

A carburetor for use in combination with an internal combustion engine has a body with an induction passage formed therethrough; a variable venturi within the induction passage is effective for variably determining the opening of a venturi throat defined thereby; and a throttle valve situated in the induction passage downstream of the variable venturi is operatively connected to the variable venturi for positioning the variable venturi generally in accordance with the position of the throttle valve.

9 Claims, 2 Drawing Figures

VARIABLE VENTURI CARBURETOR

RELATED APPLICATION

This application is a continuation of my co-pending application Ser. No. 347,187 filed on Apr. 2, 1973 for the invention Variable Venturi Carburetor, now abandoned.

BACKGROUND OF THE INVENTION

The prior art carburetors, of the fixed venturi type, heretofore employed are required to provide a proper fuel-air mixture at idle engine operation as well as at maximum engine speeds with wide open throttle. The air flow at idle operation may be a little as 8.0 c.f.m. while at maximum engine speed and wide open throttle the air flow may be as great as 600.0 c.f.m. It can be seen that with such prior art carburetors it is attempted to provide proper fuel metering characteristics over a range of air flows varying in the order of 70:1. The main difficulty caused by the necessity to provide accurate metering control over a great airflow range arises from the fact that the carburetor which has a fixed venturi throat large enough to flow the required air capacity at conditions of wide open throttle, is also too large to generate a satisfactory metering signal or force at the venturi throat at low rates of air flow.

The general problem as set forth above was attempted to be solved by the prior art as by the development of, for example, four barrel carburetors having two or more staged barrels or bores so that only a select number of such bores were open to air flow during a first range of engine operating conditions and additional bores were opened to air flow during succeeding ranges of engine operating conditions. Such multistage prior art carburetors have not totally solved the problems and, indirectly, have often added new problems in such areas as, for example, achieving smooth transitional fuel flows as the carburetor is passing from a first stage to a second or third stage of its operation.

Others have heretofore attempted to obviate the necessity of a fixed venturi, or for that matter any venturi, by employing a variable positionable air valve within the induction passage upstream of a fuel metering valve operatively connected to such air valve. Spring means were employed to resiliently resist opening movement of the air valve which was urged in the opening direction by the air flow through the induction passage. Theoretically, the more the air valve opened the greater the rate of metered fuel flow to the induction passage. However, it can be readily appreciated that the metering accuracy of such prior art air valve carburetors was somewhat less than ideal especially when it is realized that springs usually have a spring rate tolerance of ± 8.0% while, under present emission requirements, fuel metering has a total tolerance of about 1.5%.

Heretofore, various forms of variable venturi carburetors have also been suggested primarily to provide for a greater range of required air flows. However, such carburetors have not been entirely successful in the past and are totally unacceptable in the present because of their inability to provide extremely closely controlled fuel metering requirements necessary to meet the various regulations relative to exhaust emissions. In the prior art, the variable venturi was often employed as both a variable venturi and a throttle valve with no additional throttle valve being employed downstream of such variable venturi. Consequently, the relatively very high engine developed manifold vacuum was applied to the various fuel discharge orifices resulting in an extremely high fuel metering depression. This, in turn, required that the fuel metering system, per se, had to be extremely sensitive to both air flow and change in value of the metering depression. Such sensitivity, as a practical matter, is impossible to attain especially in mass production where repeatability of performance over millions of units is essential.

Accordingly, the invention as herein disclosed and described is directed primarily to the solution of the above as well as other related problems.

SUMMARY OF THE INVENTION

According to the invention, a carburetor for an internal combustion engine comprises carburetor body means, induction passage means formed through said body means, a related source of fuel, variable venturi means situated in said induction passage means for variably determining a variably openable venturi throat, variably positionable throttle valve means situated in said induction passage means downstream of said variable venturi means, and connecting means operatively interconnecting said throttle valve means and said variable venturi means for causing said variable venturi means to assume positions determined by said throttle valve means and correspondingly determine the effective opening of said variably openable venturi throat.

Various general and specific objects and advantages of the invention will become apparent when reference is made to the following detailed description of the invention considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF PREFERRED EMBODIMENT

Figure 1:
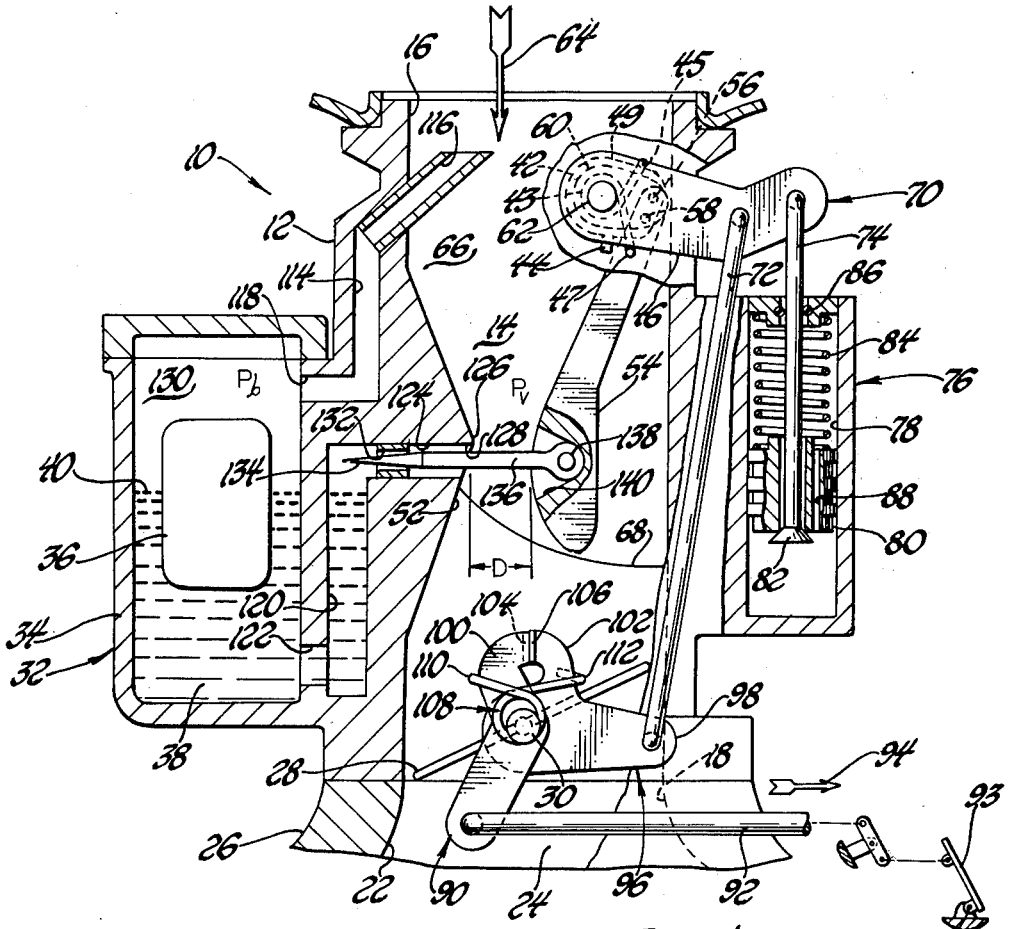
FIG. 1 illustrates, in cross-section, a variable venturi carburetor constructed in accordance with the teachings of the invention.

Referring now in greater detail to the drawings, FIG. 1 illustrates a carburetor assembly 10 having a body or housing means 12 with an induction passage 14 formed therethrough with such induction passage 14 having an air inlet end 16 and an outlet for discharge end 18 leading to an inlet 22 of the interior 24 of an intake manifold 26 of an associated internal combustion engine. A variably positionable throttle valve 28, mounted as on a throttle shaft 30 for pivotal rotation therewith, is situated within the induction passage and effective for controlling the flow of motive fluid or combustible mixture from said induction passage 14 into the intake passage 24 of engine manifold 26. Generally, such combustible mixture will, of course, be comprised of atmospheric air admitted into inlet end 16 and fuel supplied to the induction passage 14 from an associated fuel reservoir or fuel bowl assembly 32.

The fuel bowl assembly 32 is illustrated as comprising a suitable bowl or housing structure 34 which may contain a float member 36 controlling an associated fuel inlet needle valve assembly (not shown but well known in the art) so as to maintain the level of the fuel 38 within the bowl 34 at a preselected level as at 40.

As illustrated, the variable venturi may be comprised of a variably positionable venturi plate or member 54 which may be fixedly secured, in any suitable manner, as by fastener means 56, 58, to an internally disposed arm 60 which, in turn, is fixedly secured to a rotatable shaft 62 journalled in the housing means 12. The venturi arrangement may preferrably, but not necessarily, be such as to define a generally rectangular opening at the throat of the variable venturi when viewed, for example, in the direction of arrow 64. In fact, opposite walls, one of which is shown at 66, may define flat planar surfaces permitting the variable or movable venturi plate 54 to be closely received therebetween for swingable motion about the centerline of rod or shaft 62. Such flat or planar surfaces would preferrably terminate as at a boundary line 68 from which the portion of the induction passage means 14 downstream thereof would transitionally change configuration until it became circular to accommodate a generally circular throttle valve as at 28.

A second lever 70, which may be situated generally outboard of the housing means 12, is suitably secured as at one end to shaft 62 for rotation thereabout and has it swingable arm portion connected as to linkage rods 72 and 74. It is to be understood that lever 70 could be positioned internally of the carburetor body. Rod 74 comprises a portion of a dashpot assembly 76 which is illustrated as having an internal cylindrical chamber 78 containing therein a suitable fluid and a slideable piston member 80 through which the rod 74 freely extends as to be abuttably engageable therewith at its lower portion 82. A compression spring 84 also contained within chamber 78 continually resiliently urges piston 80 downwardly. Suitable sealing means such as at 86 may be provided for preventing the escape of damping fluid from chamber 78. Generally, as piston 80 is moved upwardly by rod 74, the fluid in chamber 78 above the piston 80 is forced to a position below the piston 80. This may be done as by calibrated bleed means 88 formed through piston 80 or any other such equivalent means well known in the art.

A third lever 42, which may be situated generally between the housing means 12 and lever 70, is suitably fixedly secured to shaft 62 for rotation in unison therewith. The lever 42 may be provided with a somewhat downwardly depending and laterally extending abutment type arm portion 44 which, when in the position shown, abuts against surface 46 of lever 70. Further, suitable spring means, such as a coiled-type torsion spring 43, situated about an outboard portion of shaft 62, has its opposite spring arms 45 and 47 operatively engaged with surfaces 49 and 46 of levers 42 and 70, respectively, thereby tending to rotate the variable venturi plate 54 generally clockwise with respect to lever 70.

A lever 90 suitably fixedly secured to throttle shaft 30, for rotation therewith, is operatively connected to motion transmitting linkage means 92 leading to, for example, the vehicle operator's foot-controlled throttle pedal 93 so that when moved in the direction of arrow 94 the throttle valve 28 is moved counter-clockwise in the opening direction about the centerline of throttle shaft 30.

A second lever 96 mounted on throttle shaft 30 in a manner permitting free relative motion with respect to and about shaft 30, has an arm portion 98 pivotally connected to linkage 72. Levers 90 and 96, in turn, respectively have arm portions 100 and 102 which carry generally transversely extending abutment portions 104 and 106. A torsion spring 108, having its main coil generally about shaft 30, has its arm 110 and 112 respectively operatively engaged with lever arm portions 100 and 102 as to thereby normally resiliently maintain abutments 104 and 106 engaged with each other resulting in unitary motion of levers 90 and 96.

Suitable vent passage means 114, having a first end 116 communicating with a suitable source of atmospheric pressure (or a source indicative of such atmospheric pressure), has its other end 118 communicating with the interior 130 of the fuel bowl 34.

Fuel delivery and metering means is illustrated as preferrably comprising passage or conduit means 120 communicating with the fuel bowl 34 as at 122 and with a second generally laterally disposed fuel delivery conduit means 124 which has an end 128 communicating with induction passage 14 preferably at a point immediately downstream of venturi throat portion 126 of fixed venturi section 52.

Calibrated passage means 132, provided in conduit means 124, may be suitably contoured so as to cooperate with a contoured metering portion 134 of a needle-like valve member 136 which may be pivotally secured as by a pivot member 138 to the movable venturi plate 54 as within a recess 140 formed therein.

OPERATION OF INVENTION

The operation of the carburetor 10 is generally as follows. That is, if it is assumed that the associated engine is operating, as foot throttle pedal 93 is moved counter-clockwise about pivot 95 linkage 92 is moved to the righ causing levers 90, 96, shaft 30 and throttle valve 28 to rotate generally counter-clockwise about the centerline of shaft 30 in the throttle valve opening direction. Such opening movement or motion is transmitted via cooperating linkage means 72 to lever 70 which rotates generally counter-clockwise about the centerline of shaft 62. Simultaneously therewith, because of the air flow through induction passage means 14, variable venturi plate 54 is similarly rotated about the centerline of shaft 62 as to maintain abutment or stop means 44 of lever 42 (which rotates in fixed unison with venturi plate 54) in abuting engagement with surface or edge 46 of lever 70. Such abuting engagement is maintained against the relatively light opposing resilient force of spring 74.

As lever 70 is thusly rotated counter-clockwise, stem or linkage 74 moves dashpot piston 80 upwardly through the fluid medium in chamber 78 forcing such fluid medium to pass through the calibrated passage means 88. If the rate of rotation of lever 90 is in excess of a predetermined rate, the resistance to flow of fluid medium through passage means 88 will be sufficient to retard the rate of upward movement of piston 80 to the degree resulting in the actual rate of rotation of lever 70 and variable venturi plate 54 being less than the rate of rotation of throttle lever 90. If this condition is achieved, as for example, during requests for rapid acceleration or increased output power of the engine, abutment portions 104 and 106 of levers 90 and 96 will momentarily separate from each other against the resistance of spring 108 and will subsequently return to their abutting condition once sufficient travel of linkage 72 and lever 70 is permitted by the time delay or dashpot means 76.

Such time delay means 76 is preferably provided to overcome a condition which may be referred to as fuel lag. That is, as between the fuel and air, fuel has a greater density and therefore greater inertia. Consequently, if the venturi plate 54 were to be suddenly rapidly opened, the volume rate of air flow would respond to the newly indicated desired rate of air flow much more rapidly than would the fuel. If this were to occur, the ratio of the fuel-air mixture might well become too lean (in terms of fuel) causing improper engine operation. Accordingly, by providing such time-delay means comprising 76, a maximum rate of opening movement of variable venturi plate 54 is established as to make sure that the fuel flow will have sufficient time to correspondingly respond to the indicated change in demand for rate of fuel flow.

Obviously, as throttle valve 28 is rotated clockwise toward the more nearly closed throttle position, lever 70 will positively follow such movement because stem 74 may slide relatively to piston 80, regardless of the resistance experienced by piston 80; this, in turn, causes corresponding positive movement of variable venturi plate 54 because of abutment 44 being forced generally clockwise about shaft 62 by the motion of lever 70. Accordingly, it can be seen that under rapid throttle opening conditions the venturi opening lags the throttle opening which eliminates the need for an acceleration pump.

As should be evident, generally, the rate of fuel flow from fuel bowl 32 to the induction passage 14 (as from the discharge orifice or nozzle means 128) is primarily dependent upon the metering pressure differential $\Delta P$ (often referred to as metering depression) determined by the difference of $P_b - P_v$ where $P_b$ is the pressure above the fuel 38 within the fuel bowl 34 and $P_v$ is the effective pressure (often referred to as venturi vacuum) in the induction passage 14 at or slightly downstream of the venturi throat or generally depicted by the variable dimension, D.

Unlike a carburetor having a fixed venturi throat dimension whereby, generally, a change in the volume rate of air flow therethrough produces a correlated change in the value of the venturi vacuum, a carburetor having a variable venturi does not exhibit such characteristics.

For example, in fixed venturi carburetors, the venturi vacuum or reduced pressure generated at the venturi throat is actually dependent on the velocity of flow of air through such venturi throat. However, in reality, because of the fact that the venturi throat is of a permanently fixed dimension (and therefore of a fixed flow area), such rate of flow of air is usually referred to in terms of a volume rate of flow because the rate of flow of air, described in either terms of volume rate of flow or velocity rate of flow is the same since velocity and volume are directly related.

In a carburetor of the invention employing a variable venturi, the venturi throat flow area is variable in accordance with the variable dimension, D. Therefore, the velocity rate of flow of air through the variable venturi throat is directly related to the volume rate of flow of air at all positions of the movable venturi plate 54.

Accordingly, it can be seen that because in a carburetor with a fixed venturi the generated venturi vacuum is proportional to the square of the rate of airflow through the venturi (see FIG. 2, curve A), the same relationship exists in a carburetor having a variable venturi, except that the specific values of venturi vacuum are different for each venturi opening at a given air flow. Further, for any given venturi opening, the venturi vacuum is proportional to the square of the air flow. It is also well known that the flow through a jet or restriction is proportional to the square root of the $\Delta P$ across the jet. Thus, the dominant metering characteristic of the variable venturi carburetor is fuel flow directly proportional to air flow at any given venturi position.

In the carburetor of the invention, the movable venturi plate 54 is placed at a relatively close distance with respect to the fixed venturi section 52 during curb idle engine operation (as for purposes of illustration might be considered to be depicted by the position of the various elements shown in FIG. 1) to thereby create a metering vacuum sufficient to cause metering fuel flow through passage means 120 and 124 into the induction passage 14 even though the volume rate of air flow at this condition of engine operation is, relatively, very small. By thusly closely spacing the movable venturi plate 54, the small volume rate of air flow, during curb idle engine operation, is caused to sufficiently accelerate through the venturi throat resulting in the necessary venturi vacuum being generated.

Figure 2:
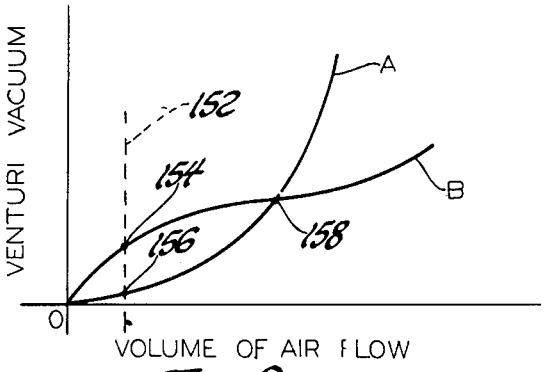
FIG. 2 is a graph illustrating characteristic venturi vacuum curves generated by the typical prior art fixed venturi carburetor and by the carburetor of the invention.

FIG. 2 graphically depicts the characteristic curves, of the prior art fixed venturi type carburetor and the variable venturi carburetor of the invention, by plotting the generated venturi vacuum, against the volume rate of air flow in each of such carburetors. Curve A represents the curve characteristically developed by the prior art fixed venturi carburetors while curve B characteristically represents a curve developed by the carburetor of the invention.

From an inspection of the graph of FIG. 2, it can be seen than curves A and B both originate from the zero point and intersect at a point 158. Further, if vertical dash-line 152 is assumed to represent a typical air flow for a particular engine at curb-idle operation, it can be seen that line 152 intersects curves B and A respectively at points 154 and 156 and that point 154 represents a substantially greater magnitude of generated venturi vacuum than that represented by point 156. It is also apparent that for all values of air flow between line 152 and point 158, curve B represents venturi vacuum values greater than those vacuum values represented by corresponding portion of curve A. Consequently, in order to reduce the effective magnitude of the venturi vacuum generated in the variable venturi of the invention and thereby effectively lower and shape the portion of the curve between points 154 and 158, as far as its effect on the fuel to be metered is concerned, metering type valving means 132 and 134 are provided with metering surface 134 being carried by valving member 136 positioned by venturi plate 54.

Generally, the closer that venturi plate 54 is to venturi section 52 the greater will be the restriction to flow of metered fuel through the restriction passage means 132. This, of course, means that the effect of the actual vacuum generated at the venturi throat is to that degree diminished as a factor on the rate of metered fuel flow discharged at the nozzle means or discharge orifice 128. Further, as the venturi plate 54 is opened, the actual volume rate of air flow through the venturi throat may actually increase by a factor substantially greater than the resulting venturi vacuum. Therefore, in order to compensate for such a diverse relationship, metering surface 134 is moved further to the right as to provide for a greater effective fluid flow area as between surfaces 134 and 132 thereby properly increasing the rate of metered fuel flow therethrough even though the magnitude of the generated venturi vacuum may not have greatly increased.

The preferred embodiment of the invention also provides additional benefits other than the ability of closely tailoring metered fuel flow to the volume rate of air flow during all conditions of engine operation. For example, upon engine shutdown the relatively low preload force of the relatively high rate spring 43 causes variable venturi plate 54, through lever 42, to rotate generally clockwise with respect to lever 70 until venturi plate 54, for example, contacts and abuts against the fixed venturi section 52. At this time, of course, throttle valve 28 will be closed as to its curb-idle position while lever 70 will assume its maximum clockwise position.

The provision of thusly causing the venturi plate 54 to abut against fixed venturi section 52 during engine shut down results in maximum reduction (if not total closure) of effective flow area through calibrated passage means 132. Further, during subsequent engine cranking where the volume rate of air flow is very low, the air thusly passing through the induction passage 14 serves to very slightly move the venturi plate 54 generally counter-clockwise, against the force of spring 43, and such slight movement is sufficient to form an opening through which the flows at a velocity sufficient to cause metered starting fuel flow through calibrated passage means 132 and into the induction passage 14. Once the engine is started, the resulting force of flow of curb idle air flow is sufficient to rotate venturi plate 54 counter-clockwise to the degree that related abutment member 44 abuts against lever 46 arresting further such relative movement of venturi plate 54. Thereafter, as should be obvious in view of the description hereinbefore presented, the position of venturi plate 54 is determined by and correlated to the position of the throttle valve 28.

The fact that the invention provides a throttle valve in combination with a variable venturi results in another important benefit which is, the ability to very closely and accurately meter fuel flow in accordance with predetermined fuel requirements. That is, because the throttle valve is downstream of the variable venturi and the fuel discharge nozzle means, the manifold vacuum developed by the associated engine is not permitted to act directly on either the variable venturi or the fuel discharge nozzle as to effect the metering depression.

Although only one preferred embodiment of the invention has been disclosed, it is apparent that other embodiments and modifications of the invention are possible within the scope of the appended claims. For example, although preferred it is nevertheless not essential that such lost motion or spring means 43 be employed and to that extent it is possible to have variable venturi plate 54 operatively fixedly secured to lever 70. It is likewise possible that the preferred dashpot or time delay means 76 may be dispensed with or even replaced by other means providing the same ultimate function.

Further, it should clearly be understood that even though the invention has been disclosed, for purposes of simplicity and clarity, in only a single bore or induction passage embodiment, the invention may be practiced in the form of a multiple bore or induction passage carburetor or in some combination thereof.

We claim:

1. A carburetor for an internal combustion engine, comprising carburetor body means, induction passage means formed through said body means, a related source of fuel, variable venturi means situated in said induction passage means for variably determining a variably openable venturi throat, a fuel passage means comprising metering restriction means between said source of fuel and said induction passage and discharging fuel into said passage adjacent said venturi throat, the dominant metering characteristic of said carburetor being venturi depression at said throat proportional to the square of the airflow through said throat, fuel flow through said restriction means proportional to the square root of said metering depression, resulting in fuel flow directly proportional to airflow, said variable venturi means comprising a first fixed venturi section and a second variably positionable venturi section, said first venturi section and said second venturi section cooperating to define said variably openable venturi throat therebetween, variably positional throttle valve means situated in said induction passage means downstream of said variable venturi means, connecting means operative interconnecting said throttle valve means and said second variably positionable venturi section for causing said second venturi section to assume opening positions determined by the position of said throttle valve means and correspondingly determine the effective opening of said variably openable venturi throat over the entire range of throttle movements from closed throttle to wide open throttle, said restriction means comprising calibrated orifice metering means and calibrated valve metering means, said calibrated orifice metering means and said calibrated valve metering means being relatively movable with respect to each other in order to thereby cooperatively define an effective fuel metering area, and one of said calibrated metering means being directly positioned by said second variably positionable venturi section and not any portion of said connecting means in order to thereby assure said effective fuel metering area to be totally dependent upon the actual position of said second variably positionable venturi section and thereby assure said effective fuel metering area to be correct for the then existing effective opening of said variably openable venturi throat, said connecting means comprising first and second lost motion means, said first lost motion means enabling said throttle valve means to at times move in the throttle opening direction without absolutely causing a corresponding movement of said second venturi section, and said second lost motion means enabling said second venturi section to move toward a further reduced venturi throat opening after said throttle valve means has attained a curb idle position.

2. A carburetor according to claim 1, and further comprising time delay means, said time delay means being effective to at least at times cause a retarding effect on movement of said second venturi section.

3. A carburetor according to claim 2, wherein said time delay means comprises dashpot means.

4. A carburetor according to claim 3, wherein said dashpot means comprises a chamber containing a fluid medium therein, a moveable wall member received within said chamber adapted to be moved in a manner to displace at least a portion of said fluid medium, resilient means biasing said movable wall member toward one position, means operatively connecting said movable wall member to said variable venturi means and effective for at times moving said wall member in a direction away from said one position, and restriction means for restricting the flow of said fluid medium from one side of said wall member to the other side thereof as said wall member is moved away from said one position.

5. A carburetor according to claim 4, wherein said movable wall member comprises a piston-like plunger closely slidably received within said chamber.

6. A carburetor according to claim 1, wherein said connecting means comprises spring means effective for at least at times permitting said throttle valve means to move in the throttle opening direction without simultaneously causing corresponding movement of a corresponding magnitude in said second venturi section, and further comprising time delay means, said time delay means being effective to at such times exhibit a retarding effect on the movement of said second venturi section.

7. A carburetor according to claim 6 wherein said throttle valve means and said time delay means are operatively connected to said second venturi section.

8. A carburetor according to claim 1, wherein said second lost motion means comprises resilient means normally tending to move said second venturi section in a direction resulting in a reduction in the opening of said variable venturi throat.

9. A carburetor such as that recited in claim 1, wherein said connecting means limits opening of said second venturi section in accordance with throttle opening but at times permits limited closing of said second venturi section.

* * * * *

UNITED STATES PATENT OFFICE

CERTIFICATE OF CORRECTION

Patent No. 3,937,768 Dated February 10, 1977

Inventor(s) Kenneth C. Bier et al.

It is certified that error appears in the above-identified patent and that said Letters Patent are hereby corrected as shown below:

On the cover sheet Item (73) Assignee should read:

-- Colt Industries Operating Corp., --.

Signed and Sealed this

Thirty-first Day of May 1977

[SEAL]

*Attest:*

RUTH C. MASON
*Attesting Officer*

C. MARSHALL DANN
*Commissioner of Patents and Trademarks*